US005124513A

United States Patent [19]

Blair

[11] Patent Number: 5,124,513

[45] Date of Patent: Jun. 23, 1992

[54] FLEXIBLE ELECTRICAL SWITCH EXTENDER

[76] Inventor: Earl Blair, 1330 Belhaven Rd., San Marino, Calif. 91108

[21] Appl. No.: 688,035

[22] Filed: Apr. 19, 1991

[51] Int. Cl.[5] ..... H01H 3/20

[52] U.S. Cl. ..... 200/331; 200/308

[58] Field of Search ..... 200/331, 332, 335, 339, 200/308, 309, 302.3, 302.2; 74/544; 16/115, 116.2, DIG. 14, DIG. 41, 114 R, 111 R, DIG. 12; 24/127.6, 129 D; 174/DIG. 8, 84 R; 284/12

[56] References Cited

U.S. PATENT DOCUMENTS

| | | | |
|---|---|---|---|
| 992,009 | 5/1911 | Lang | 200/302.3 |
| 1,570,315 | 1/1926 | Newhall | 200/308 |
| 2,885,105 | 5/1959 | Heyl et al. | 174/DIG. 8 X |
| 2,919,334 | 12/1959 | Jones | 200/331 X |
| 3,121,778 | 2/1964 | Sander et al. | 200/331 |
| 3,175,420 | 3/1965 | Craig | 200/331 X |
| 3,188,438 | 6/1965 | Lovosco | 200/302.3 X |
| 3,243,211 | 3/1966 | Wetmore | 174/DIG. 8 |
| 3,581,037 | 5/1971 | Schiffelbein | 200/331 |
| 3,722,319 | 3/1973 | Reznick et al. | 200/331 X |
| 3,847,183 | 11/1974 | Meyer | 174/DIG. 8 X |
| 3,911,241 | 10/1975 | Jarrad | 200/302.2 X |
| 3,928,742 | 12/1975 | Rule | 200/302.3 |
| 4,256,943 | 3/1981 | Whitlock | 200/331 |
| 4,297,155 | 10/1981 | Jervis | 174/DIG. 8 X |
| 4,545,375 | 6/1985 | Cline | 200/302.2 X |
| 4,924,034 | 5/1990 | Truesdale et al. | 174/DIG. 8 X |
| 4,934,024 | 6/1990 | Sexton, I | 16/111 R |
| 5,046,143 | 9/1991 | Chen | 200/331 |

*Primary Examiner*—Ernest G. Cusick
*Assistant Examiner*—Glenn T. Barrett
*Attorney, Agent, or Firm*—Wagner & Middlebrook

[57] ABSTRACT

A heat shrinkable tube-like extension for toggle switch operators. In its preferred embodiment is comprises a length of heat shrink tubing with one end coated with a bondable plastic material. The one end is heated and comprised to form a beaver tail end thereafter the open end is inserted over the end of the handle of a toggle switch. Heat is applied to the end over the handle to shrink it into engagement with the handle. In an alternate embodiment, a flat insert is placed in the open end before heat shrinking. It is then heated to flatten the outer end. The extenders may be color coded and also may include printed or hand lettered switch identification on the extension portion.

14 Claims, 3 Drawing Sheets

FIG. 1
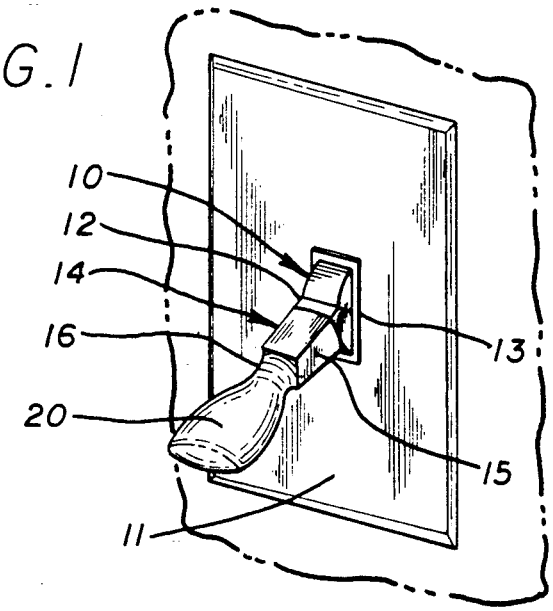
FIG. 2a
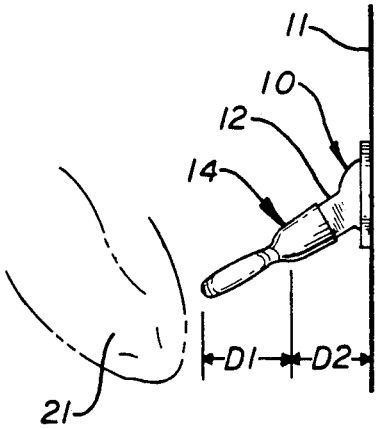
FIG. 2b
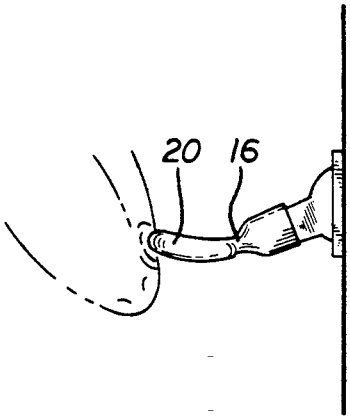
FIG. 2c
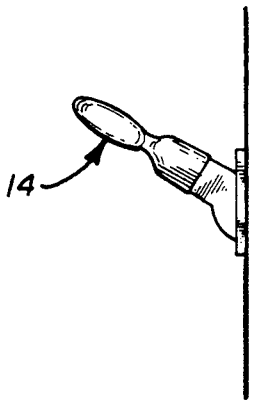
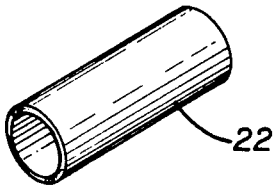
FIG. 3
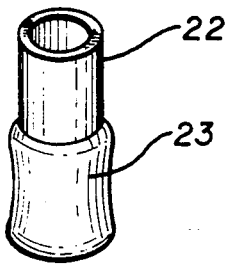
FIG. 4
FIG. 5
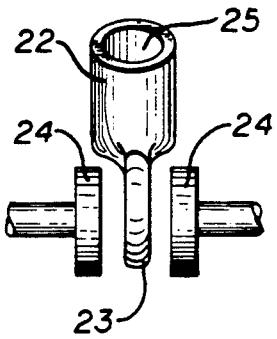

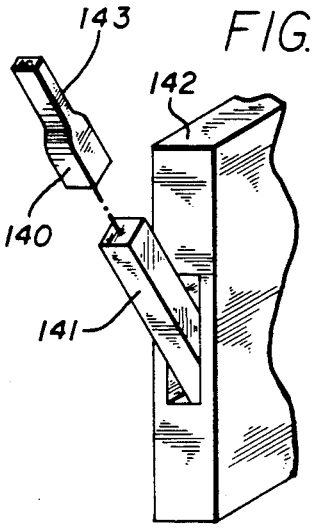
FIG. 11
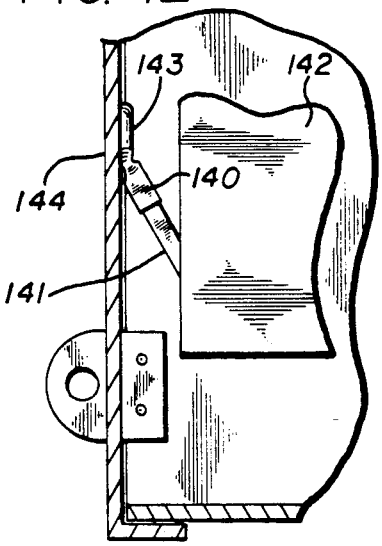
FIG. 12
FIG. 13
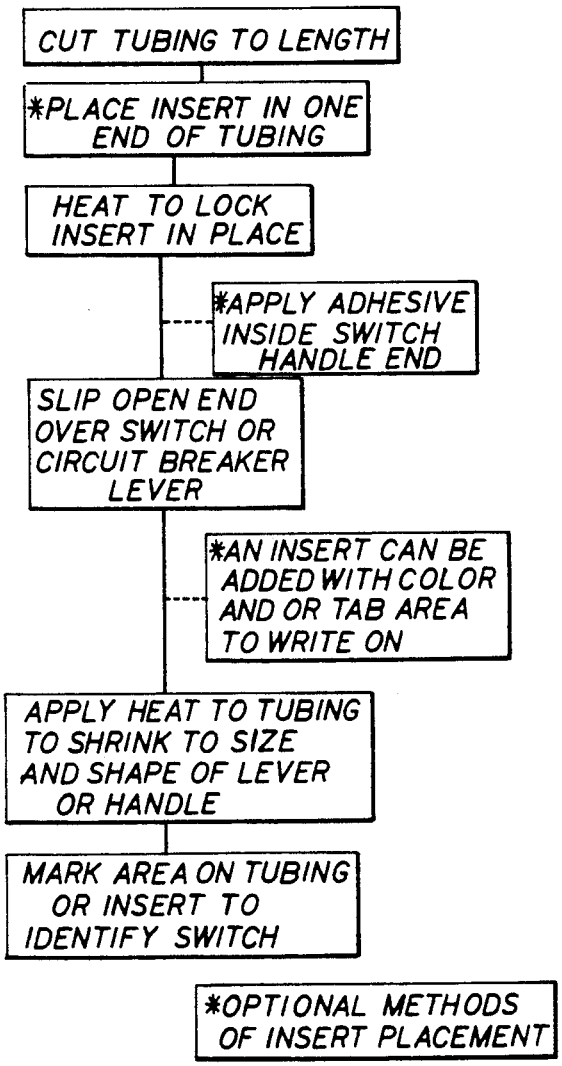
FIG. 14
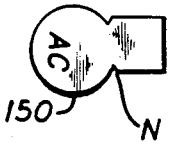
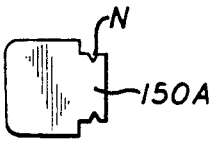
FIG. 15
FIG. 16
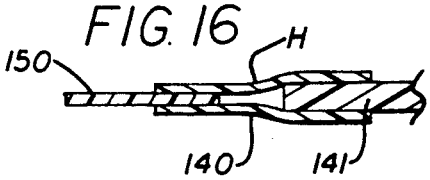
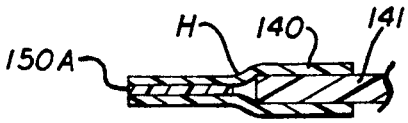
FIG. 17

FLEXIBLE ELECTRICAL SWITCH EXTENDER

BACKGROUND OF THE INVENTION

In the field of electrical switches, particularly for household, industrial and commercial use, the toggle switch with an outward extending handle is, perhaps, the most numerous of all the types of switches. The toggle switch is designed to be operated by the fingers, usually from a position pointed angularly downward representing an off position to an angled upward position meaning that the controlled circuit is in its on or operated condition. Usually the handle is directly mechanically coupled to a bipolar electrical switch. Sometimes three position switches employ a toggle.

I have encountered on many occasions entering a room with my arms full and attempting to operate a switch either with one available finger, an arm, or an elbow Without guaranteed success. This can be a minor inconvenience or it can endanger the load being carried. Some toggle switches have longer than normal switch operators somewhat like a knife blade and those switches can often be inadvertently operated by someone brushing past the switch. Likewise, they can be painful if one strikes the switch, particularly, end on.

I have also encountered the difficulty where there is a bank of switches, particularly in the case of a panel of 20 to 100 circuit breakers of identifying the switch or circuit breaker to be operated or more importantly, to identify to another person which switch should be operated and which switches should not be operated. Typically, circuit breaker switches are black, have short stubby handles and for identification, only have a number or written legend near the circuit breaker to indicate what circuit it covers. One reason for short handles on circuit breakers is that there is often very little clearance between the circuit breakers and the electric panel door when closed. There is no room for a extension unless it fold's up or down because doors leaves only ⅛" clearance.

I have also discovered that toggle switches come in a vast variety of handle shapes and sizes and some have draft on sides. Consequently, handle extensions, heretofore, have to be custom designed for each model of switch or circuit breaker handle. It is a common practice in the electrical equipment industry for each manufacturer to have slight differences in their equipment to require use of only their switches or circuit breakers.

BRIEF DESCRIPTION OF THE INVENTION

Faced with the foregoing state of the art, it occurred to me that a simple but effective solution to the foregoing problem is to provide for the switch owner a flexible plastic extension in generally closed tube form which may be slipped over almost any of shape or size of switch handle and through the application of localized heat, shrink the extension about the toggle handle sufficiently to secure it on a semi-permanent basis. The extension will typically double the length of the toggle switch operator handle to allow the switch to be operated with the arm or the elbow as easily as with the fingers. Moreover, the extension is flexible such that it will deform if struck from any direction other than in the switch operating direction and cannot cause injury if someone runs up against the switch since the extension merely bends out of the way.

Moreover, my toggle switch extensions are color coded so that any bank of switches, the extensions are different in color and the color can be the basis for selection for operation. For example, red coded switch extensions mean never operate except in an emergency. Blue color can mean lighting circuits. Yellow can mean heater. Green can mean outside lights. Black can mean water heater, etc. for as many different colors as are desired. Typically, instructions can be given that, at the close of business, the green switches be operated and all other switches remain in their normal position.

In order for this concept to be effective, I have found that the switch extension not only must be flexible, but must adapt to a variety of sizes and shapes of toggle switch handles. I have determined that certain heat shrinkable tubing materials have a shrink capability of 50% or more which means that a tube having an inside diameter for shrinking of ½" can serve to extend and code a large variety of switches.

I have also determined that it is possible to select a heat shrinkable material which may be printed or marked with an indelible pin to mark the operator itself. Moreover, by placing a flat insert within the tabs before heat shrinking it, the extension is flattened without the need for clamping. The insert stiffens the extension and provides a good base for a writing surface.

BRIEF DESCRIPTION OF THE DRAWING

This invention may be more clearly understood from the following detailed description and by reference to the drawing in which:

FIG. 1 is a perspective view of a switch operator extension of this invention in use;

FIGS. 2A–C are a side elevational view of the switch of FIG. 1 being operated by the elbow;

FIGS. 3–7 are a series of steps showing the manufacture of switch extensions in accordance with one method of this invention;

FIG. 11 is a fragmentary perspective view of a circuit breaker with an extender of this invention;

FIG. 12 is a fragmentary side elevational view of a circuit breaker of FIG. 11 with the electrical panel door closed;

FIG. 13 is a flow diagram of the steps of manufacturing the extension of FIGS. 11 and 12.

FIGS. 14–17 are detail views showing different shapes of inserts.

DETAILED DESCRIPTION OF THE INVENTION

Figure 6:
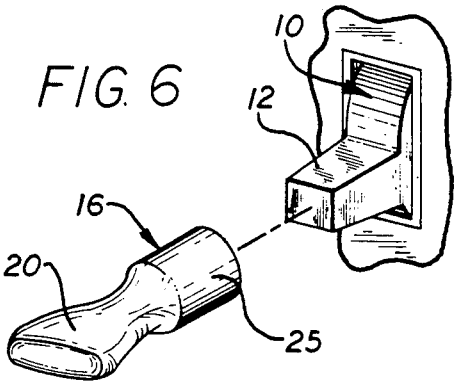

Now referring to FIG. 1, a typical toggle switch generally designated 10 is shown mounted behind a switch plate 11 and having a switch operator handle 12 which extends through an opening 13 in switch plate 11. The toggle switch 11 is a typical household bipolar switch designed to operate lighting circuits. The switch operator 12 is shown in its typical four-sided truncated somewhat pyramidal in shape.

Extending over the switch operator 12 is the extension of this invention generally designated 14. You will note that in its preferred form and when installed, extender 14 includes a shrunk connector or mouth section 15, a neck portion 16 and a generally flattened or beaver-tailed operator section 20. The connector section 15 employing the shrink capability of the material which conforms closely to the shape of the switch operator 12 regardless of its shape and provided it has a cross sectional area of at least X% of the tubular extension member before shrinking.

Note, that in the shrinking process the neck portion retains its generally circular shape allowing easy deflection either up or down or sideways. The operator or beaver-tail portion is generally flattened and may be stiffened by either greater wall thickness in the tube or by an insert. Even when neither coated nor thicker wall section, the operator section 20 becomes nearly solid and appears to have a greater resistance to deflection than the neck portion 16. This is illustrated in FIGS. 2A-2C.

In FIG. 2A the extension capability of this invention is illustrated by extending the switch from a distance d1 from the wall plate 11 to a distance of d1+d2. In typical applications this distance is approximately 1".

In FIG. 2A an individual desiring to operate the switch need merely bring his elbow 21 near the switch operator and by lifting the elbow causes a slight deflection of the operator portion 20. By deflecting the extension causes the switch to operate to the full operated position as shown in FIG. 2C. Most deflection occurs in the neck portion 16.

The switch may be similarly turned to the off position by finger pressure, arm or elbow approaching the switch operator from the upper side. Switch operation is clearly noted by the audible switch characteristics but more clearly by the final position of the switch extension of this invention. Typically household switches have the operator the same color as the switch plate and since there is only a small degree of overhang of the switch operator, either above or below the switch opening itself, it is often difficult to observe whether a switch is in its off or on position. The presence of the switch operator extension of this invention eliminates that problem.

Referring now to FIGS. 3-7 a typical manufacture process and installation a switch operator extension in accordance with this invention may be seen. This method illustrates the method of manufacture employing standard shrink tubing. It must be recognized that standard shrink tubing is less expensive than closed end tubing of custom design and, therefore, on the basis of economy, the use of standard tubing is presently preferred.

A piece of such tubing 22 in the order of 1" in length and ⅜" in inside diameter and 0.025" wall thickness is used as a starting material. I have tested a large variety of materials and have found that the following is most effective for use in household switch extension manufacture.

Cole Flex Mfg.
New York 11704
Type ST219 Tubing

Figure 7:
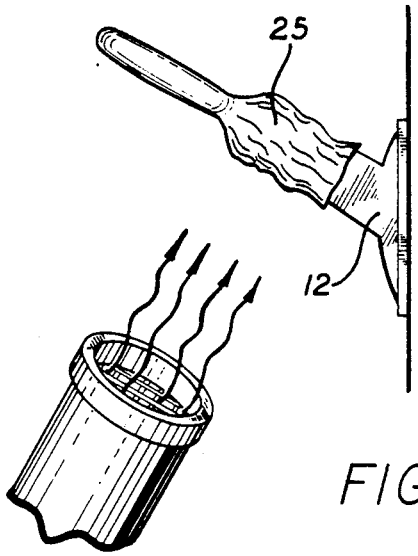

I desire to have the outer end closed and have done so by dipping one end of tubing 22 in a dip vinyl coat 23 which bonds to the outer and inner walls of one end of the tubing 22. Thereafter employing a heated clamp 24 the coated end is compressed to the flat beaver-tail configuration bonding the inner walls together and sealing the end. The localized heating of the coated end by the clamp members 24 does not affect the open or attachment end 25. Thereafter the attachment 16 is slipped over the switch operator 12 of toggle switch 11 as shown in FIG. 6 to the full extent possible. Thereafter a heat gun such as a commercial heat gun reaching a temperature of 190° or even a household hair dryer may be used to shrink the section 25 about the switch operator 12. This is illustrated in FIG. 7.

Figure 8:
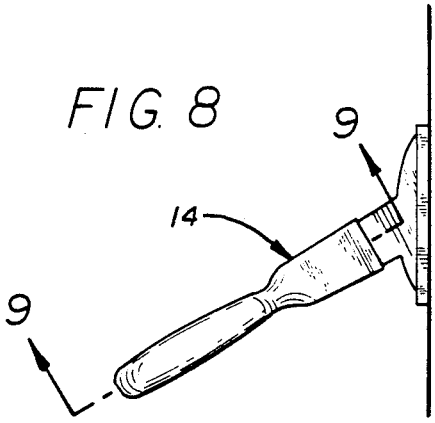
FIG. 8 is an enlarged side elevational view of a finished switch operator in accordance with this invention.

The final configuration is shown in FIG. 8 ready for use.

Figure 9:
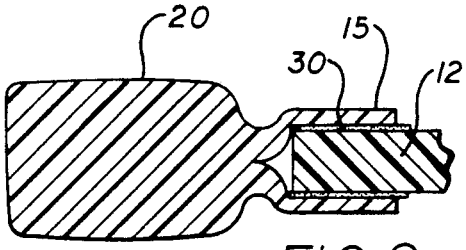
FIG. 9 is a longitudinal sectional view of this invention taken along line 9—9 of FIG. 8.

As can be seen in FIG. 9, the beaver-tail operation portion 20 is virtually solid while the attachment portion 1 closely adheres to the switch operator 12. I have also found that it is possible to use a heat setting cement lining the opening portion 15 and such a cement 30 is illustrated in FIG. 9. The use of a cement is recommended when the attachment is to be permanent. For semi-permanent operation, no cement is needed and the switch or operator may be removed by either the application of heat to section 15 or by a vigorous pull to the beaver-tail portion 20 for most tapered switches.

Figures 10A, 10B, 10C, 10D:
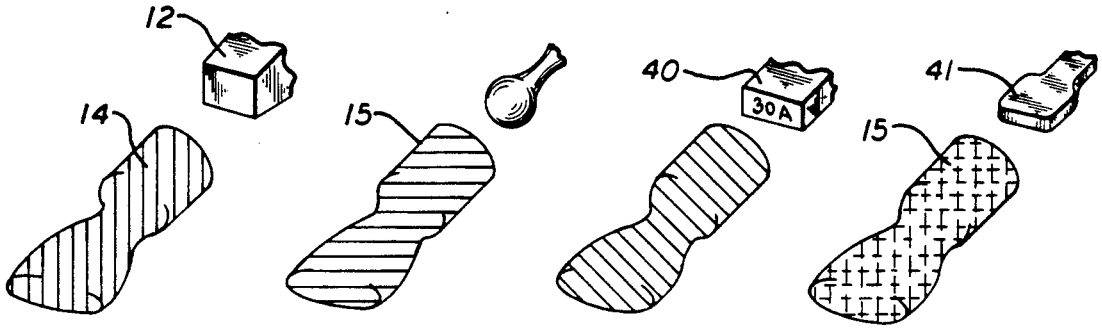
FIG. 10 is a series of four perspective views (a), (b), (c) and (d) of a variety of switch extenders in four different colors and ready for attachment to switch operators of four different sizes and shapes.

Color coding of the switch extensions 14 is illustrated in FIG. 10 employing standard U.S. Patent and Trademark Office color coding conventions. FIG. 10A illustrates a red switch extension, FIG. 10B illustrates a blue switch extension, FIG. 10C illustrates a green switch extension, and FIG. 10C illustrates a yellow switch extension. FIG. 10 further shows four different types of typical toggle switch or circuit breaker handle shapes, any of which can be extended employing this invention. In FIG. 10A a typical household switch operator 12 is illustrated. In FIG. 10B a typical metal ball end switch operator is illustrated. In FIG. 10C a typical circuit breaker operator handle is illustrated. In FIG. 10D a typical paddle switch operator 41 is illustrated.

When the switch extension of this invention is applied to any of the switch operators as illustrated in FIGS. 10B and 10D, the shape of the operator handle itself insures a virtually permanent attachment with the switch extension portion 15 shrinking around the neck portions of the switch operator. In such case if it is desired to remove the switch operator extension 16 it should be removed carefully by cutting with a sharp knife or by reheating.

In certain cases of switch handles with extreme taper, I have found that in addition to shrinkage, bonding on adhesive is type N 123 contact adhesive of the STA-BOND Corporation is eminently satisfactory. It activates when heated to a temperature lower then 150° F.

In the preferred embodiment of this invention, I employ heat shrinkable tubing. However, tubing which exhibits shrinking by other means such as chemical or radiation fall within the scope of my invention, provided such shrinking method is not incompatible with the electrical, structural and chemical standards of the switches being extended.

In applying my invention to electric circuit breakers for domestic use, I have discovered that one reason for short handles on circuit breakers is the fact that often the door or cover of the normal circuit breaker panel box fits very closely. There is no room for longer handles. Following my invention, however, I have developed foldable flexible handle extensions which are particularly adapted to circuit breakers for cramped enclosures. Such is illustrated in FIGS. 11 and 12.

In FIG. 11 a perspective view of an extension 140 is illustrated exploded from a handle 141 of a circuit breaker 142. The extension 140 has a beaver tail portion 143 with identifying printing on both sides. In this case it reads AC, indicating "air conditioner". The extension 140 is illustrated in FIG. 12 as folded slightly upward by the closed door 144. The extension 1 40 is different in design and manufacture from the embodiment of FIGS. 1–10. Its manufacture is illustrated in FIG. 13.

A blank tube 140 is cut and an insert 150 of plastic or cardboard is cut in a generally rectangular or oval shape. The insert 150 is slipped into one end of the blank tube 140 and then the opposite end of the tube 140 is slipped over the end of handle 141 with the insert extending in the appropriate direction for folding. Heat is next applied to the tube shrinking the open section around the handle 141 and the outer end around the insert. The open end is shrunk tightly about the handle for a secure attachment. The outer end shrinks in a flat form about the insert 150. A legend, e.g., AC may then be written on the outer end or may be preprinted on the exposed end of the insert. The extension is now ready for use.

FIGS. 14–17 illustrate two shapes of inserts 150, bell-shaped and 150A rectangular. They may include a slightly larger head, as shown, to limit the insertion of the insert into the tubing and may include a notch N or other discontinuity in the edge into which the tubing shrinks to provide secure attachment of the inserts.

In FIG. 16 the insert 150 extends out of the extender tubing 140 while in FIG. 17, insert 150A is enclosed in the extender tube 140. Either form will work. In both cases a hinge section H is located between the end of the handle 141 and the insert 150 or 150A.

The above described embodiments of the present invention are merely descriptive of its principles and are not to be considered limiting. The scope of the present invention instead shall be determined from the scope of the following claims including their equivalents.

What is claimed is:

1. An electrical switch operator extension for use on a switch operator of a switch said operator having an actuation lever, said switch operator extension comprising a unitary body of heat shrinkable material having an attachment portion with a recess therein of a size sufficient to surround said actuation lever of the switch operator wherein said switch operator is received in said recess, said body having a flexible to be extended extension portion and having a length approximating the length of the switch operator and being distorted with respect to said attachment portion whereby upon shrinking of the attachment portion onto said operator flexible extension portion extends beyond the actuation lever of said operator.

2. A switch operator extention in accordance with claim 1 wherein said extension comprises a length of heat shrinkable tubing and means for closing an unattached end of said tubing forming said flexible extention portion.

3. A switch operator extention in accordance with claim 1 including means for bonding the sidewall of the extension portion beyond the switch operator together to provide a non-tubular operator section.

4. A switch operator extention in accordance with claim 3 wherein the extension portion beyond the switch operator is generally flattened.

5. A switch operator extention in accordance with claim 3 including a generally circular neck portion for accommodating bending in any direction upon contact, said neck portion being positioned between said attachment portion and said extension portion.

6. A switch operator extention in accordance with claim 1 including an adhesive in the recess of the unitary body in a region to be attached to the switch operator.

7. A switch operator extention in accordance with claim 1 wherein said body is of a preselected color to color code the switch to which it is attached.

8. A method of manufacturing a switch extension for use on a switch operator of a switch, said operator having a length, the method comprising: cutting a length of heat shrinkable tubing to a length greater than the length of a switch operator to be extended;

coating one end of said tubing with a bonding material;

compressing said one end to provide a generally flattened tube; and installing the unflattened end of the tubing over the switch operator and heat shrinking the end into intimate contact with the switch operator.

9. The method in accordance with claim 8 wherein said heat shrinkable tubing is cut to a length and coated to a length at the one end such that there is remaining uncoated central section which extends beyond the switch operator when shrunk to provide a flexible neck portion.

10. A switch handle extender for use on a switch handle having a length, said switch handle extender comprising:

a length of tubular thermally shrinkable material having an inner end, an outer end and an inside diameter of sufficient size to slip said inner end over a switch handle; and a generally planar insert having a transverse diameter greater than the inside dimension of said tubular length and approximately twice the transverse dimension of the inside diameter of said tube after shrinking;

whereby said length of material may be slipped over a switch handle, an insert slipped into the outer end of said tubular length and whereby upon the application of heat to said tubular length, the tubular length is shrunk into engagement with the handle and in engagement with said insert providing a generally planar surface suitable for imprinting of indicia thereon.

11. The switch handle extender in accordance with claim 10 wherein said insert is of a length greater than the length of said tubular material such that when in place on a switch handle said insert extends beyond said tubular length after shrinking to provide a surface for receiving indicia.

12. The switch handle extender in accordance with claim 11 wherein said insert is preprinted with indicia for identifying the switch to which the extender is attached.

13. The switch handle extender in accordance with claim 11 wherein said insert is color coded.

14. A method for providing a switch operator handle with an extension, said method comprising:

cutting a length of shrinkable tubing having an inside dimension slightly larger than the switch operator handle and a length greater than the switch operator handle;

inserting a generally planar substantially rigid sheet within a portion of said tubing and heat shrinking the tubing about the switch operator handle and the insert such that said insert extends beyond said switch operator handle.

* * * * *